RESCUE APPARATUS

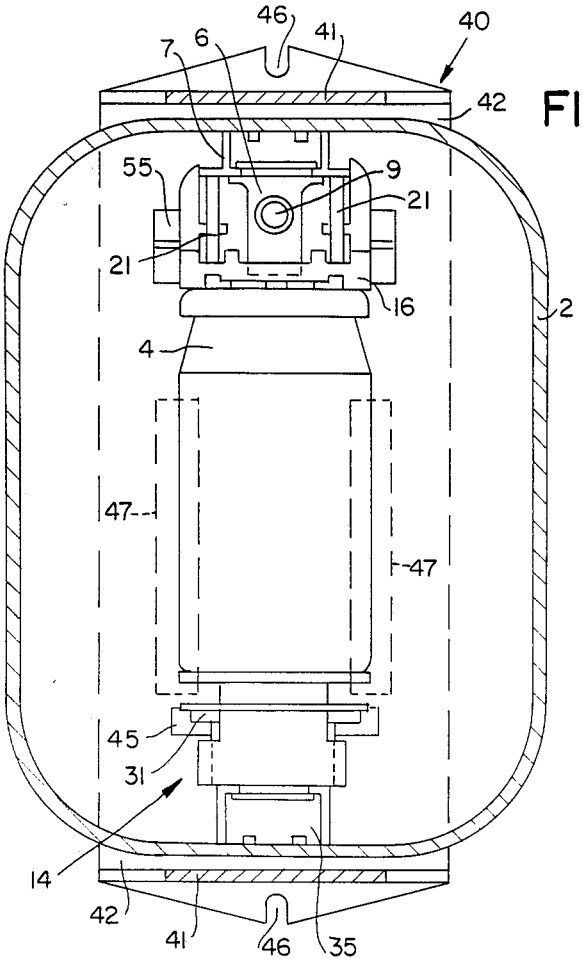
FIG. 2
FIG. 4
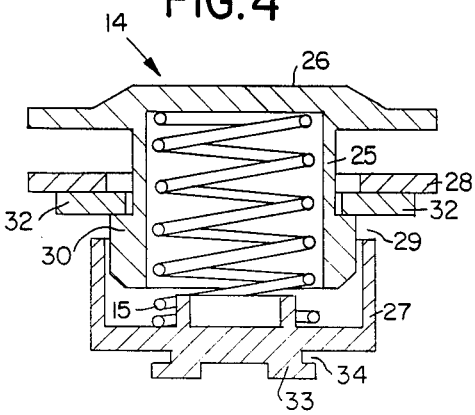
FIG. 3
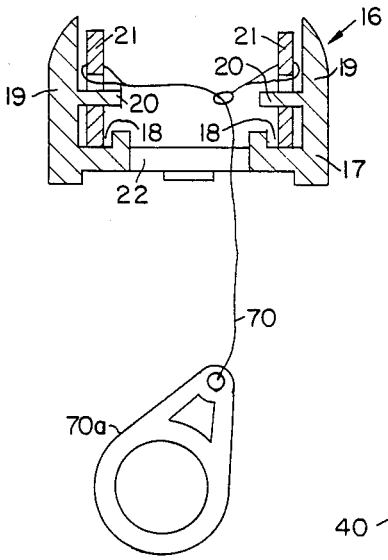
FIG. 5
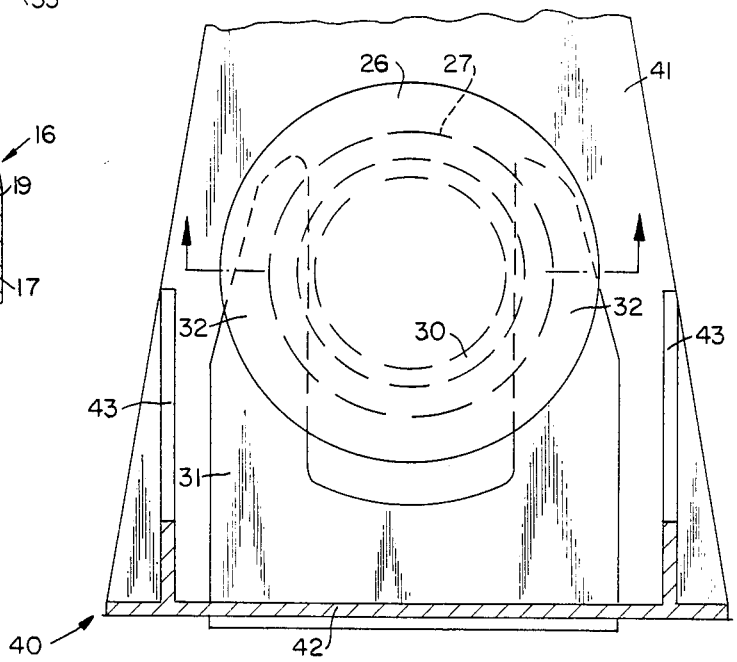

BACKGROUND OF THE INVENTION

The invention relates to a rescue-unit comprising an automatically inflatable floating element which is kept folded in a housing containing a bottle of compressed gas having a valve actuated by depressing it and a valve-actuating mechanism comprising a preloading device and support-elements blocking the actuation of the valve, the support-elements, upon coming into contact with the water, losing their strength and their supporting function in order to effect automatic release of the valve-actuating mechanism, the preloading device, loaded by the force of the spring acting against the support-elements, being locked by a locking element extending outwardly from the housing and preventing the spring from being released, the valve-actuating mechanism being brought, as soon as the locking element has been put out of action, to a state of readiness for valve-actuation initiated by the access of water.

THE PRIOR ART

A rescue-unit of this type has been proposed. In this case, the housing containing the floating element is deliberately thrown into the water near the person to be rescued, the floating element being automatically inflated as soon as the water gains access. A conventional life-belt can be thrown only a few meters and not very accurately especially if a strong wind is blowing. When the rescue-unit is not in use, a locking means must be provided to prevent actuation of the valve used in inflating the floating element. Special support-elements are used to actuate the valve, after a certain amount of delay and after the housing has been thrown into the water, the support-elements becoming soft and losing their supporting function, whereupon the valve is actuated by the preloaded spring.

In order that these support elements shall not be constantly subjected, when the rescue-unit is not in use, to the spring-pressure needed to release the valve, which would not provide protection against inadvertent release since the elements react to humidity, especially to more or less atmospheric humidity, the preloading device containing the spring must be provided with a locking element to be actuated only when the rescue-unit is to be used, in order to bring the valve-actuating mechanism into a condition of readiness in which valve-actuation can be initiated by access of water. To this end, a locking element was proposed in the form of a slide to be pressed into the housing, the said slide being held clamped between parts adapted to move in relation to each other, and being pressed out of this position in order to relieve the spring.

In the case of the proposed rescue-unit, the disadvantage of this type of unlocking means is that, after picking up the housing, one must remember to insert the locking disc before throwing the housing into the water. If this is forgotten in a panic situation, the valve-actuating mechanism does not assume the readiness condition in which the valve is actuated when the water gains access. The floating element is thus not automatically inflated and the rescue-unit fails to fulfill its purpose. The life of the person to be rescued is thus dependent upon the alertness of the person putting the rescue-unit to use, and this alertness may be lacking when urgent action is needed.

SUMMARY OF THE INVENTION

It was therefore the purpose of the present invention to provide a rescue-unit of the type mentioned at the beginning hereof which lacks these disadvantages and which, as soon as the housing is taken hold of, assumes the condition of readiness for valve-actuation by access of water, in every case. In the rescue-unit according to the present invention, this is achieved in that the locking element, which is clamped at its forked end with the two branches of the fork between a bush enclosing the spring and a bush-guide secured to the housing, is secured by its other end, located externally of the housing, to a retainer designed to secure the housing, in such a manner that, upon removal of the housing from the retainer, the forked end of the locking element is released from the position in which it is clamped by spring pressure, whereby the preloading device achieves the condition of readiness. The retainer is preferably of U-shaped design, with the legs of the U enclosing the two-part housing at opposite ends thereof. This retainer may also comprise bolt-holes for attachment to a wall. However, the retainer, with the housing may also be carried on the body, to which end the U-shaped retainer may comprise, in the web-part uniting the legs of the U, slots through which a belt may be passed. In this application, the rescue-unit carried on the body replaces a life-jacket and has the advantage, for fisherman and recreational sailors, of not inducing perspiration in hot weather.

Another purpose of the invention was to design the rescue-unit in such a manner that it not only inflates the floating element automatically upon reaching the water in order to rescue a person in the water, but may also be used by a person on board a ship to rescue himself before jumping into the water, for example.

To this end, the support-elements serving to prevent actuation of the compressed-gas-bottle valve must be destroyed mechanically. This is accomplished by means of a cord passed through the support-elements, which are in the form of annular discs, the end of the cord outside the housing being given a sharp pull after the housing has been released from the retainer.

It was a further purpose of the invention to provide a floating element more suitable than the life-belt used in known units. A closed life-belt has various disadvantages since it must be passed down over the head and shoulders if the person to be rescued is to be held, with any degree of safety, suspended in the belt with his arms over it. However, in a stressful situation frequently brought about by fear of drowning, and with wet clothing, it is not easy to pass a life-belt over the head and down to the chest; in fact in the case of heavy persons it may be quite impossible, because of the dimensions of the belt. Lack of space makes it impossible for a self-inflating life-belt, folded and accommodated in a housing, to be so large. Furthermore, a person to be rescued, wearing a life-belt around his chest, has a relatively high centre of gravity and may therefore overturn and drown. Finally, according to the Archimedes principle, a person to be rescued is heavier when a large part of his body is above the surface of the water, and the life-belt must therehave a correspondly higher load-carrying capacity, whereas a person with only his head out of the water is lighter and can be held above the water by a floating element of lower load-carrying capacity.

Thus the present invention is intended to provide a rescue-unit comprising an automatically inflatable floatsupport-elements which temporarily prevent the valve from being actuated when the actuating mechanism has already been brought to the condition of readiness after preloading device 14 has been unlocked. This allows the full force of spring 15 to act upon the support elements which, on the one hand rest in channels 18 in holder 16 and, on the other hand, bear against bracket 7 secured to housing-part 2, as may be gathered from FIGS. 1 and 2. Connecting piece 5 of the compressed-gas bottle passes through a central hole 22 in holder 16.

Disc-shaped support elements 21 are made of a material which rapidly loses its strength in water, for example cardboard impregnated with a means for reducing surface tension, thus allowing the water to penetrate quickly into the fibres of the cardboard, such as glycerolpolyethylene-glycoloxystearate, for example, dissolved in a rapidly evaporating organic solvent, for example isopropanol. The advantage of this over untreated cardboard is that the valve on the compressed-gas bottle is actuated within only 1 to 3 seconds after the rescue-unit reaches the water, the floating element being fully inflated thereafter within 6 to 15 seconds. The supporting elements may also be made of another material which dissolves completely in water. The elements may also be of a configuration other than disc-like, as long as the holder associated therewith is designed accordingly.

The preloading device 14, shown to an enlarged scale in FIGS. 4 and 5, comprises a bush 25 having an upper support-plate 26 against which bottle 4 of compressed gas rests. One end of the helical spring 15, arranged within piston-like bush 25, bears against support plate 26, while the other end bears against the base of a cylindrical bush-guide 27. The latter comprises an upper flanged edge 28 and, immediately thereunder, on opposite sides, slots 29. Bush 25, enclosing spring 15, comprises, at its lower end, an outwardly projecting flange 30. Clamped between flange 30 and flanged edge 28 of bush-guide 27, under the action of compression spring 15, is forked locking element 31, with its two legs 32, visible in plan view in FIG. 5. Bush-guide 27 comprises a base 33 with grooves 34 on opposite sides, the said grooves serving to secure preloading device 14 detachably to a bracket 35 which is integral with housing-part 2 and comprises elements engaging in the said grooves.

Forked locking element 31 is a piece of flat material, the rear end of which is secured to a retainer 40, as shown in FIG. 5. The holder is U-shaped, with two legs 41 united by a web-part 42 integral therewith. Retainer 40 is preferably made of a synthetic material and also comprises two reinforcing ribs 43 extending along web-part 42 between legs 41, as shown in FIG. 5 in which one leg 41 of retainer 40 is shown broken away. Legs 41 of retainer 40 engage housing parts 2 and 3 at the upper and lower end and are provided at their ends, bent slightly inwardly, with bosses 44 engaging in corresponding recesses in the outside of housing-part 3. Housing 1, and the parts therein, are thus secured at three locations in retainer 40, to wit by locking element 31, which extends outwardly through slot 45 in housing part 2 and is secured to the retainer, and by bosses 44 at the ends of legs 41. Web-part 42 of the retainer also comprises openings 46 for accommodation of attachment bolts for securing the retainer to a wall or some other element. Attachment can also be effected by means of self-adhesive strips on the back of the retainer. The web-part of the retainer also comprises two parallel slots 47 through which a belt may be passed if the rescue-unit is to be carried on the body (FIG. 2).

When the rescue-unit is to be used in the event of an emergency, all that is needed is to wrench housing part 1 out of retainer 40. This releases locking element 31 from the position in which it is clamped, under pressure from spring 15, between flange 30 of bush 25 and flanged edge 28 of bush-guide 27. This produces the readiness condition in which the full force of the spring acts upon disc-like support elements 21. As soon as the rescue unit reaches the water, these elements lose their strength and buckle. The forward thrust of bottle 4 of compressed gas presses valve-connecting piece 5 inwardly and floating element 11 is inflated automatically, thus separating housing parts 2 and 3 from each other.

In order that the unit may be used not only to rescue a person already in the water, in which case the floating element is inflated automatically when the unit reaches the water, but also by a person on board a ship, so that he can jump into the water with the floating element already inflated, disc-like support-elements 21 may also be destroyed mechanically. To this end, a cord 70 is passed through annular discs 21, the end of the cord being fitted with an eye **70*a* through which the person may pass his finger so that he may give the cord a vigorous pull. The cord leaves housing-part 2 through an opening 55 and hangs down between the housing-part and retainer 40. It is therefore not visible from the front of the unit and is thus less likely to be pulled unnecessarily. After housing 1 has been withdrawn from retainer 40, bringing preloading device 14 to the condition of readiness, cord 70 must be pulled to destroy support-elements 21. This inflates floating element 11**, allowing the person to place it around his neck before jumping into the water.

In order to protect the floating element while it is stored folded within the housing, a cover 50 is arranged between housing-parts 2 and 3. This cover is semi-cylindrical is shape and encloses bottle 4 of compressed gas and the entire valve-actuating mechanism. Each end of cover 50 is fitted with a tab 51 having an extension 52 engaging in a corresponding hole in housing-part 2 for the purpose of securing the said cover. In the vicinity of support-elements 21, housing-part 2 is provided with an opening 55 through which water can gain access thereto.

Housing part 3 is connected to floating element 11 by s strap 56 which remains inside the housing as long as the floating element remains folded therein. When the floating element is inflated, housing part 3, connected thereto by the strap, acts as a sea-anchor to prevent the floating element from being blown by the wind away from the person to be rescued. In order to ensure rapid sinking, so that it can act as a sea-anchor, housing-part 3 has holes 57 distributed over its surface. The strap also prevents housing part 3 from being lost in the water and may, with advantage, be made from the material of the floating element, as a part of the edge thereof running around it in the plane of symmetry, externally of weld-seam 58. When the floating element is completely finished, this strap may be torn from it along a pre-perforated line. Housing-part 2 is attached to floating element 11 by a strap 59 which can be passed through the housing behind cover 50, the ends of the strap being secured in the vicinity of weld-seam 58.

According to FIG. 7, floating element 11 is in the form of a U-shaped collar with a slot 62 running between legs 60,61 towards the centre and terminating in a circular neck-opening 63. The U-shaped collar, open between the legs, is easier to put-on than a conventional life-belt which must be pulled down over the head and shoulders, if the person to be rescued is to be held, with some degree of security, with his arms hanging down outside. Under these circumstances, however, there is a danger of overturning since the person's centre of gravity is relatively high, in which case an unconscious person would drown. Apart from this, a life-belt large enough to pass over a person's shoulders could scarcely be accommodated in the housing. In contrast to this, a U-shaped collar fitted around the neck keeps only the person's head above water, so that his centre of gravity is low, there is no danger of overturning, and an unconscious person does not drown. In order to hold the U-shaped collar closely together around the neck, legs 60,61 of floating element 11 may be connected together in the vicinity of the neck opening by means of a button 73 and a button-hole 74. In addition to this, a belt 72 is secured to leg 61 of floating element 11, which the person using the unit should pass around his back, securing the other end to leg 60 by means of a button 71, for example. This ensures that the floating element is well secured to the person to be rescuted and cannot slip off over his head. Moreover, hand-grips 67,68 are fitted to the outwardly projecting edge of the material of the floating element which is made in two halves welded together; these hand-grips make it easier to grasp the floating element and also allow other persons to hang on.

Bottle 4 of compressed gas contains a liquid gas having a very low boiling point. Since compressed-gas bottles containing the liquid gas normally used have the disadvantage that the valve ices-up at low air or water temperatures, as a result of which satisfactory operation of the rescue-unit can no longer be guaranteed, it is essential to use a liquid gas with a low boiling point which must also be incombustible and non-toxic. In order to meet these conditions, bottle 4 of compressed gas contains a mixture of 89% Freon 12 and 11% propane. If this mixture is used, there is scarcely any icing-up of the valve even at a water-temperature of 1° C.

The embodiments of the invention in which an exclusive property or privilege is claimed are defined as follows:

1. In a rescue unit which includes a perforated housing containing an inflatable floating element, a valved bottle of compressed gas which is movable from a first position within the housing wherein the valve thereon is closed to a second position wherein the valve thereon is open, a connection means for conveying compressed gas from said bottle when in said second position to said inflatable floating element for inflation, a plurality of water-sensitive support elements which are positioned to prevent said bottle of compressed gas from moving from said first position to said second position until contacted by water flowing into said perforated housing, and a preloading device which can move said bottle of compressed gas from said first position to said second position; said preloading device including a fixedly mounted bush guide having an outwardly-extending flange edge, a bush having an outwardly extending flange which is movably positioned within said bush guide, a spring for biasing said bush away from said bush guide so as to tend to move said bottle of compressed gas from said first position to said second position and a locking element which is movably positioned between said flanged edge of said bush guide and said flange of said bush to lock them in position near one another or else to release them to enable said spring to move them apart, said locking element having a base portion which extends outwardly of said housing, the improvement wherein said rescue unit includes a retainer to which said housing is removably attachable, and wherein the base portion of the locking element of said preloading device is fixedly attached to said retainer, such that when said housing is manually separated from said retainer, said locking element will be removed from between the flanged edge of the bush and the flange of the bush guide of said preloading device, thus enabling said spring to move them apart.

2. The rescue unit according to claim 1, wherein said housing has an upper end and a bottom end, and wherein said retainer is generally U-shaped and comprises a web part and two legs extending away from said web part, said legs being respectively engagable with the upper and lower ends of said housing.

3. The rescue unit according to claim 2, wherein said retainer includes means for attachment to a wall.

4. The rescue unit according to claim 2, wherein said web part of said retainer includes slots through which the belt of a person desiring to carry said rescue unit can pass.

5. The rescue unit according to claim 1, wherein said support elements are in the form of discs, and wherein said rescue unit includes a chord which is attached at one end to said discs and which passes outwardly of said housing, the manual pulling of said chord causing said discs to break.

6. The rescue unit according to claim 1, wherein said inflatable floating element is in the form of a U-shaped collar comprising opposing legs and, adjacent the opening-slot running between the legs, a circular neck-opening in the middle of the collar.

7. The rescue unit according to claim 6, wherein said housing comprises two separable parts, said bottle of compressed gas being positioned in a first of said two parts and said inflatable floating element being positioned in the second of said two parts.

8. The rescue unit according to claim 7, including a strap connecting one leg of said U-shaped collar to said first part of said housing.

9. The rescue unit according to claim 6, wherein said inflatable floating element includes two hand-grip means.

10. The rescue unit according to claim 6, including a safety belt having first and second ends, one end of said safety belt being fixedly attached to one leg of said inflatable floating element and the second end of said safety belt being attachable to the second leg of said inflatable floating element, and wherein said legs of said inflatable floating element include means to fixedly connect them together.

11. The rescue unit according to claim 1, wherein said bottle of compressed gas contains a mixture of at least two liquid gases, the boiling point thereof being low enough to ensure that the valve on the bottle of compressed gas does not become unserviceable due to icing at an ambient temperature of 1° C.

12. The rescue unit according to claim 11, wherein said mixture of liquid gases consists of 89% of Freon 12 and 11% of propane.

13. The rescue unit according to claim 11, wherein said mixture of liquid gases is incombustible and non-toxic.

14. The rescue unit according to claim 1, wherein said support elements comprises discs of cardboard containing glycerol-polyethylene-glycoloxy-stearate as a surface tension-reducing agent, said discs loosing their shape when exposed to water in about 1 to 3 seconds.

* * * * *

United States Patent [19]

Hoshino

[11] Patent Number: 4,563,157

[45] Date of Patent: Jan. 7, 1986

[54] COLD-PROOF WATER-PROOF GARMENT

[75] Inventor: Takahiro Hoshino, Yokohama, Japan

[73] Assignee: Toyo Bussan Kabushiki Kaisha, Tokyo, Japan

[21] Appl. No.: 596,385

[22] Filed: Apr. 3, 1984

[51] Int. Cl.[4] ..... B63C 9/12

[52] U.S. Cl. ..... 441/104; 114/311

[58] Field of Search ..... 441/35, 37, 40, 80, 441/87, 102–119, 124; 2/2.1 R, 125; 114/311

[56] References Cited

U.S. PATENT DOCUMENTS

| | | | |
|---|---|---|---|
| 2,782,430 | 7/1957 | Radnofsky | 441/104 |
| 2,784,425 | 3/1957 | Bicknell | 441/37 |
| 2,911,649 | 11/1959 | Ruelle et al. | 441/104 |
| 2,941,210 | 6/1960 | Bren | 2/125 |
| 3,369,263 | 2/1968 | Kreckl | 441/104 |
| 3,696,453 | 10/1972 | Harris et al. | 441/80 |
| 3,771,169 | 11/1973 | Edmund | 2/2.1 R |
| 4,187,570 | 2/1980 | De Simone | 441/37 |

FOREIGN PATENT DOCUMENTS

| | | | |
|---|---|---|---|
| 3121318 | 12/1982 | Fed. Rep. of Germany | 441/103 |
| 818546 | 9/1937 | France | 441/103 |
| 175493 | 10/1982 | Japan | 441/104 |
| 559613 | 2/1944 | United Kingdom | 441/105 |

*Primary Examiner*—Galen L. Barefoot
*Assistant Examiner*—Stephen P. Avila
*Attorney, Agent, or Firm*—L. Lawton Rogers, III

[57] ABSTRACT

This cold-proof water-proof garment is designed to be worn by someone working in cold seas, or aboard a ship in distress at sea, to protect the life of the wearer if he should fall into the sea.

Figure 1:
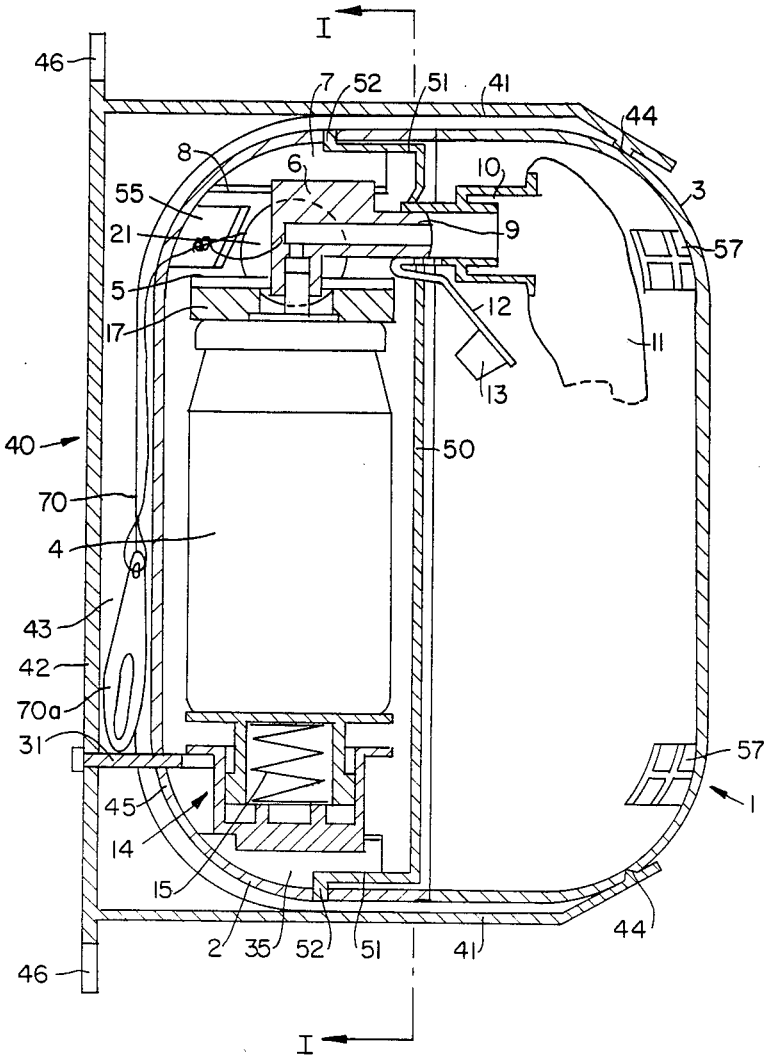
Figure 6:
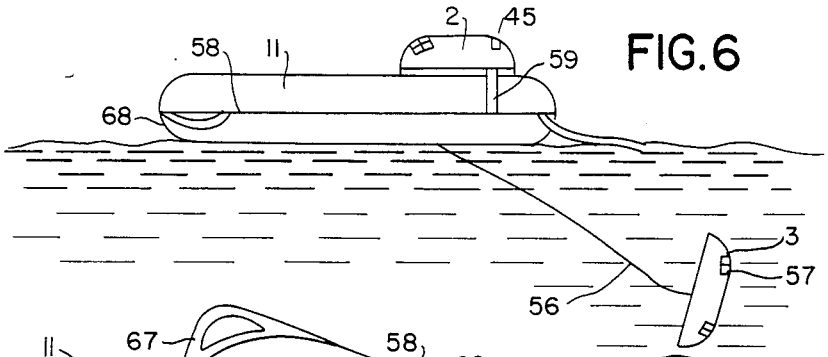
Figure 7:
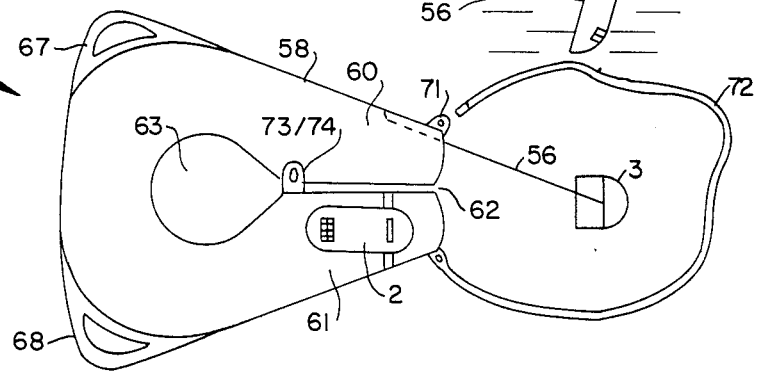
Figure 8:
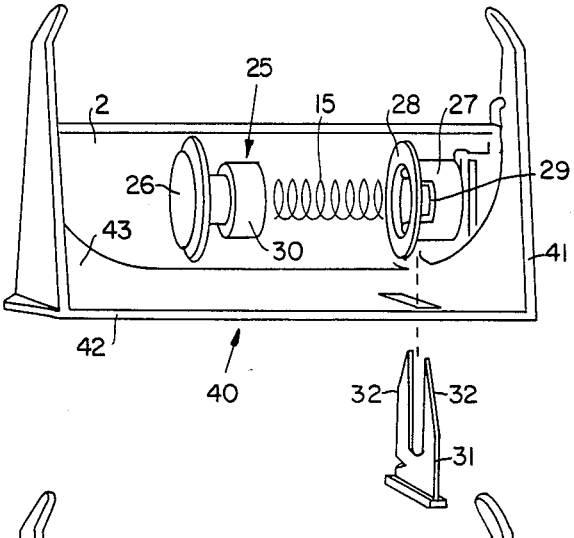
Figure 9:
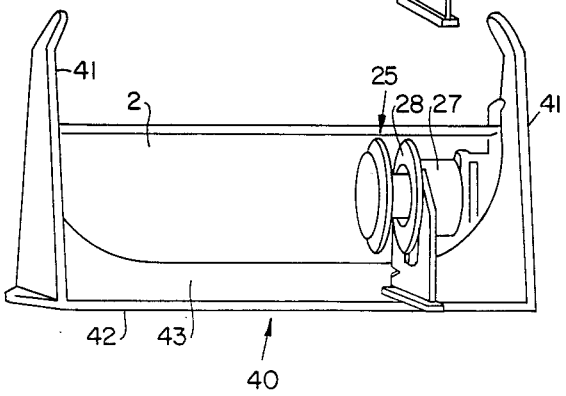
Figure 10:
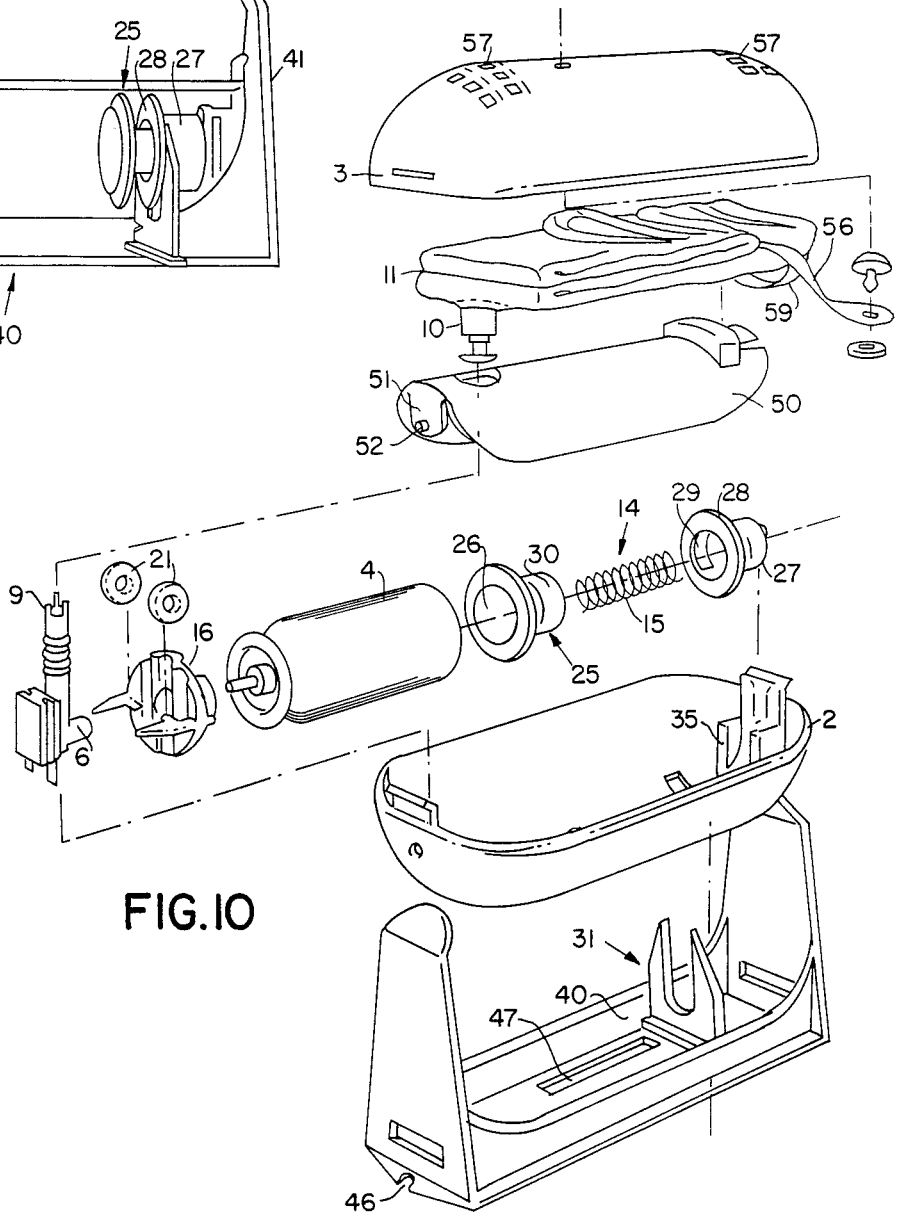

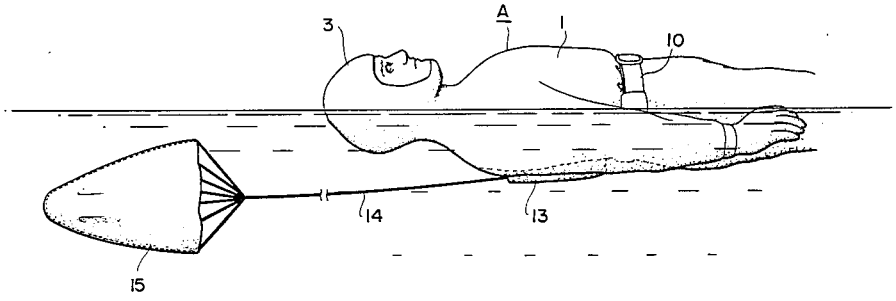

3 Claims, 9 Drawing Figures